US009988850B2

(12) United States Patent
Crawford et al.

(10) Patent No.: US 9,988,850 B2
(45) Date of Patent: Jun. 5, 2018

(54) SYMMETRICAL SEAL

(71) Applicant: Halliburton Energy Services, Inc., Houston, TX (US)

(72) Inventors: Micheal B. Crawford, Montgomery, TX (US); Mark E. Williams, Conroe, TX (US); Young H. Lee, Conroe, TX (US); David P. Duckworth, Conroe, TX (US); Zhaohui Shan, The Woodlands, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 307 days.

(21) Appl. No.: 14/654,788

(22) PCT Filed: Dec. 31, 2012

(86) PCT No.: PCT/US2012/072307

§ 371 (c)(1),
(2) Date: Jun. 22, 2015

(87) PCT Pub. No.: WO2014/105081

PCT Pub. Date: Jul. 3, 2014

(65) Prior Publication Data

US 2015/0345226 A1 Dec. 3, 2015

(51) Int. Cl.
*E21B 10/25* (2006.01)
*E21B 10/22* (2006.01)

(52) U.S. Cl.
CPC ..... *E21B 10/25* (2013.01); *E21B 2010/225* (2013.01)

(58) Field of Classification Search
CPC ..... E21B 10/08; E21B 10/22; E21B 10/23; E21B 10/24; E21B 10/25; E21B 2010/22; E21B 2010/225
See application file for complete search history.

(56) References Cited

U.S. PATENT DOCUMENTS 4,290,497 A * 9/1981 Barnetche ..... E21B 10/25 175/371
5,129,471 A * 7/1992 Maurstad ..... F16J 15/3456 175/228

(Continued)

FOREIGN PATENT DOCUMENTS

CN 102587835 A * 7/2012 ..... E21B 10/25
CN 102587835 A 7/2012

OTHER PUBLICATIONS

Chinese Office Action for Patent Appiication No. 2012800780680 dated Mar. 11, 2016, 7 pages.

(Continued)

*Primary Examiner* — Waseem Moorad
*Assistant Examiner* — Christopher J Sebesta
(74) *Attorney, Agent, or Firm* — Haynes & Boone, LLP

(57) ABSTRACT

A downhole seal system for roller cone drill bits includes a seal gland having a width larger than it depth. In one implementation, the seal gland includes a protrusion along its base on which a seal element seats. The seal element is a single, annular seal element with a recess formed therein so as to define two lobes. The seal element seats in the gland so that the recess engages the protrusion. The lobes function as separate seal elements, although they are a single unitary seal element disposed in a single gland.

24 Claims, 6 Drawing Sheets

(56) References Cited

U.S. PATENT DOCUMENTS

| | | | | |
|---|---|---|---|---|
| 5,230,520 | A * | 7/1993 | Dietle | E21B 4/003 277/559 |
| 5,563,512 | A | 10/1996 | Mumby | |
| 6,254,275 | B1 * | 7/2001 | Slaughter, Jr. | E21B 10/25 175/369 |
| 6,536,542 | B1 * | 3/2003 | Fang | E21B 10/25 175/371 |
| 2003/0094766 | A1 * | 5/2003 | Byrd | E21B 10/25 277/549 |
| 2005/0056462 | A1 * | 3/2005 | Burr | E21B 10/25 175/57 |
| 2006/0032673 | A1 * | 2/2006 | Yong | E21B 10/25 175/372 |
| 2008/0073124 | A1 | 3/2008 | Lin | |

OTHER PUBLICATIONS

International Search Authority, International Search Report and Written Opinion, dated Mar. 5, 2013, 9 Pages, United States Patent and Trademark Office.

* cited by examiner

SYMMETRICAL SEAL

FIELD OF THE DISCLOSURE

This disclosure relates generally to equipment utilized and operations performed in conjunction with drilling boreholes for the recovery of oil, gas or minerals. More particularly, the disclosure relates to roller cone drill bits with an extended life seal. Most particularly, the disclosure relates to elastomeric seals that seal and protect the bearing surfaces between the roller cone cutters and the journal shafts on which they rotate.

DESCRIPTION OF THE RELATED ART

Roller cone drill bits typically include a bit body with a plurality of journal segment legs. Conical rolling heads referred to as "cones" are mounted on bearing pin shafts (also called journal shafts or pins) that extend downwardly and inwardly from the journal segment legs. Cutting elements are mounted on cones. As the bit is rotated at the end of a drill string, each cone is caused to rotate on its respective journal shaft. The bit body may include one or more nozzles to inject a drilling fluid adjacent the cones, which drilling fluid is utilized to carry away cuttings from the borehole.

To facilitate rotation of the cones, bearings are provided between the cones and the bit body, and lubricant is provided for the bearings. To prevent external debris from damaging the bearings or otherwise causing excessive wear in the rotating of a cone, and to prevent escape of the lubricant, a seal is typically provided in a gland formed in either the cone or journal shaft.

Persons of ordinary skill in the art will appreciate that drill bits used to drill boreholes have to operate in an extremely hostile environment. The seals must withstand elevated temperature and pressure and may be subject to corrosive fluids, all of which can negatively impact the life of the seals.

In order to extend the life of a drill bit, it is common for certain drill bits to include at least two glands and two seals along the length of the cone and/or shaft. The second seal is provided as a redundant seal in the event of failure of the outermost seal.

One drawback to this configuration is that it is only utilized with drill bits of a certain size, where there is sufficient cone/shaft length to install multiple glands without significantly impacting the bearing contact surface area.

DESCRIPTION OF ILLUSTRATIVE EMBODIMENTS

Illustrative embodiments and related methodologies of the present disclosure are described below as they might be employed to seal bearing surfaces within a drill bit. In the interest of clarity, not all features of an actual implementation or methodology are described in this specification. It will of course be appreciated that in the development of any such actual embodiment, numerous implementation specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the disclosure will become apparent from consideration of the following description and drawings.

Figure 1:
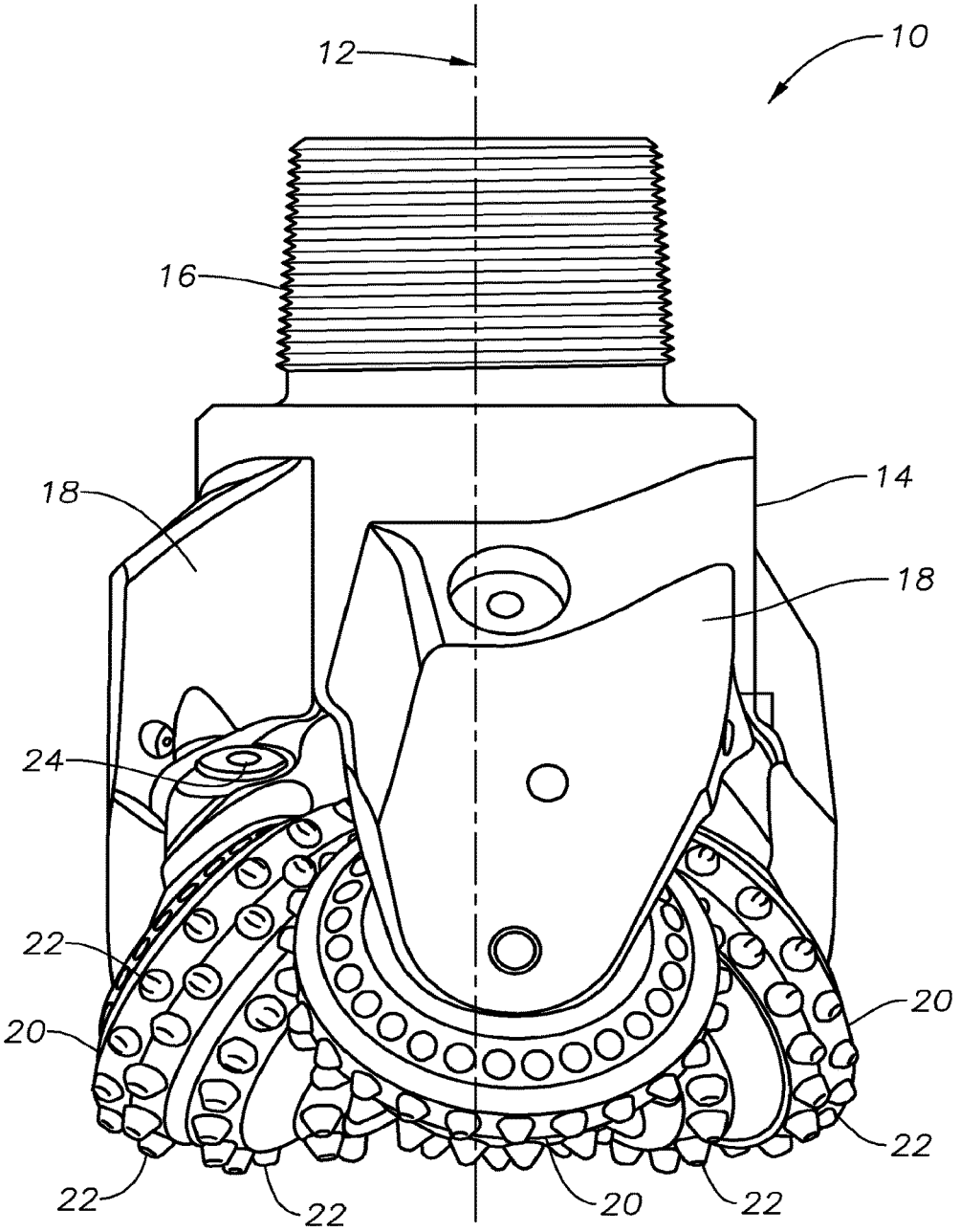
FIG. 1 is a three dimensional view of a roller cone drill bit used in drilling wellbores.

FIG. 1 is a three dimensional view of a roller cone drill bit 10 used in drilling wellbores. Drill bit 10 is formed around a central axis 12 and is characterized by a body 14 having a threaded portion 16 on its upper end for securing the bit to the drillstring (not shown). Body 14 is formed of multiple arms 18. A cone 20 is rotatably connected to each arm 18. In the illustrated example, there are three each of the arms 18 and cones 20. While three arms are illustrated, it should be understood that the principles of this disclosure may be incorporated into drill bits having other numbers of cones and arms, and other types of drill bit configurations. The drill bit 10 depicted in FIG. 1 is merely one example of a wide variety of drill bits which can utilize the principles described herein.

Each cone is provided with a plurality of cutting teeth 22.

Bit 10 further includes nozzles 24 disposed in the bit body 14 so as to transmit a flow of drilling fluid from the interior of the drill bit 10 to the cutting surfaces of cones 20 in order to cool drill bit 10, clean the cutting teeth/elements 22, and to transport formation cuttings from the bottom of a wellbore (not shown) to a wellbore annulus (not shown) and, subsequently, to the surface.

Figure 2:
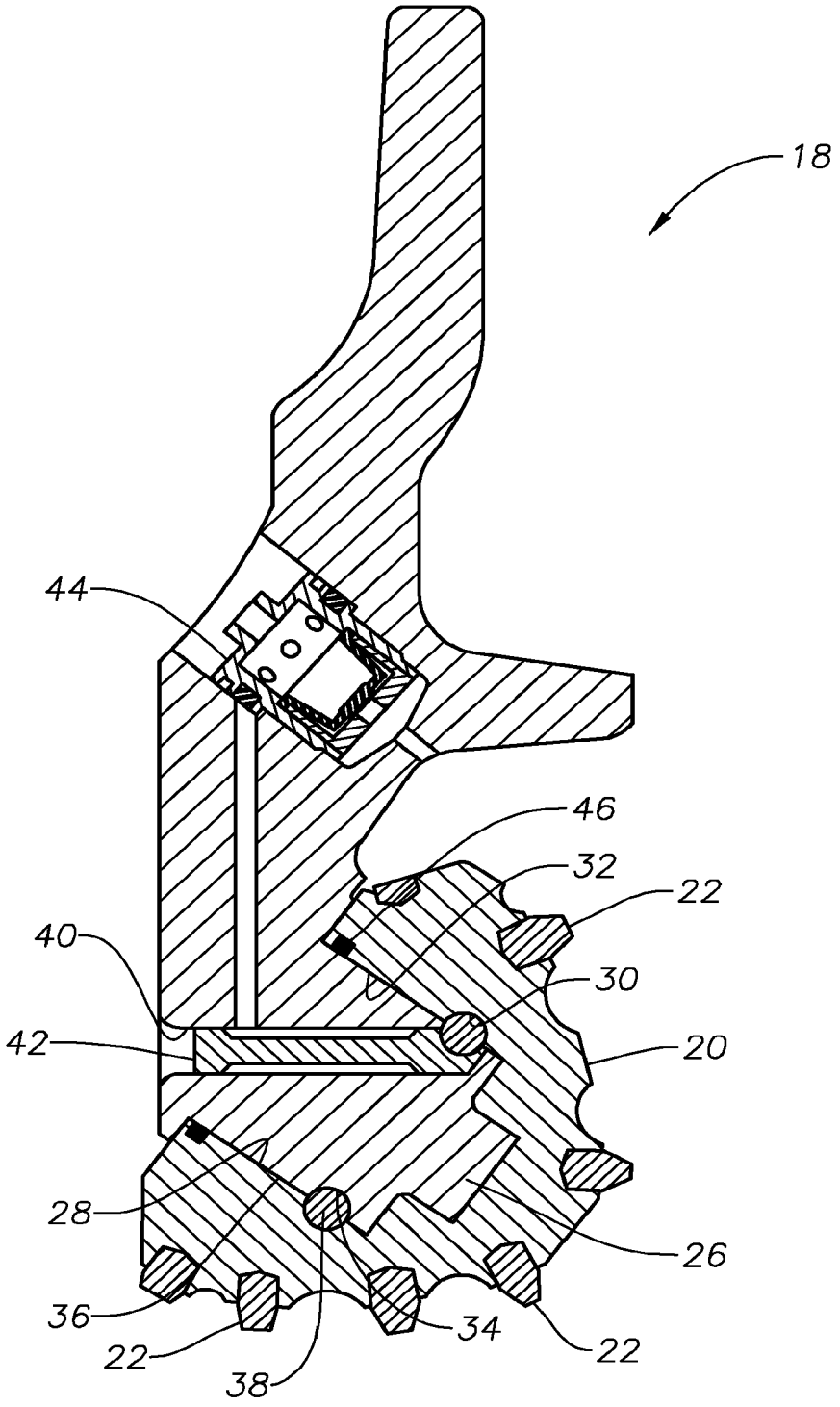
FIG. 2 is a cross-sectional view of an arm of a roller cone drill bit.

FIG. 2 is a cross-sectional view of one of the arms 18 of drill bit 10 is illustrated. As shown, each cone 20 is rotatably mounted on a journal pin or shaft 26 that is oriented generally inward toward central axis 12 and downward, away from threaded portion 16 of bit 10. More specifically, shaft 26 is disposed to sit within a central cavity or bore 28 formed within cone 20. A circumferential race or groove 30 is formed along the inner surface 32 of cone 20 at the distal end of the bore 28. Likewise, a corresponding circumferential race or groove 34 is formed along the outer surface 36 of journal pin 26 at its distal end so as to be adjacent race 30 when cone 12 is mounted on journal pin 26.

A bearing or locking ball 38 is disposed to seat within races 30, 34 to secure cone 20 to journal pin 26. Persons of ordinary skill in the art will appreciate that a channel 40 is provided in journal pin 26 and intersects race 34 to form a passageway for placement of bearings 38 during assembly. After the bearings 38 are in place, a retainer 42 is inserted into channel 40 to secured bearings 38 in place.

Lubricant is supplied to the interface between inner surface 32 of cone 20 and outer surface 36 of journal 26. A pressure equalizing device 44 may be provided to ensure that during drilling, the lubricant is maintained at substantially the same pressure as the downhole environment. In certain embodiments, a portion of channel 40 is utilized to supply the lubricant to the interface.

A seal assembly 46 is formed at the interface at the proximal ends of journal 26 and cone 20. As the cone 20 rotates about the journal 26, the seal assembly 46 preferably rotates with the cone and seals against an outer surface of the journal. As such, seal assembly 46 functions to inhibit debris and well fluids from entering the interface between the cone 20 and journal 26, and also to inhibit escape of the lubricant from the interface area.

Figure 3:
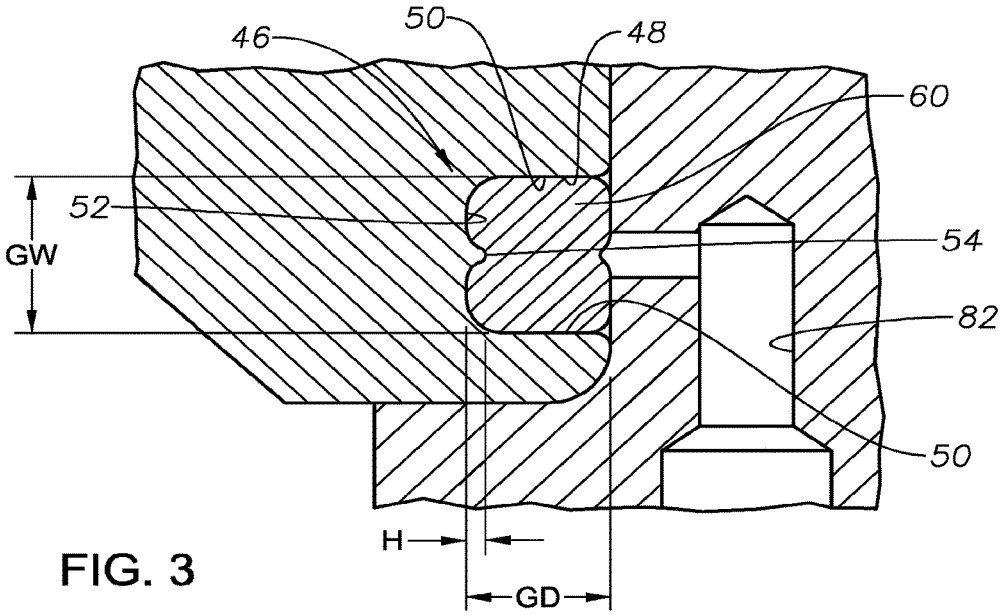
FIG. 3 is a cross-sectional view of a seal assembly of the disclosure.

With reference to FIG. 3, in certain preferred embodiments, seal assembly 46 (generally shown in FIG. 2) is formed of a single circumferential groove or gland 48 having an overall gland width (GW) and an overall gland depth (GD), wherein the overall gland width GW is equal to or greater than the overall gland depth GD. In certain preferred embodiments, groove 48 is characterized by opposing side surfaces 50 and a base surface 52 extending therebetween. A circumferential, axial protrusion 54 is formed along base surface 52. Protrusion 54 is not limited to a particular shape, but in preferred embodiments may have a square or rounded or peaked cross-section. In certain embodiments, protrusion 54 is generally characterized as having a height (H) of no more than 50% of overall gland depth GD, while in other embodiments, height H is no more than 25% of overall gland depth GD, while in yet other embodiments, height H is a dimension between approximately 5-25% of overall gland depth GD. Overall gland depth GD may be equal to, greater or smaller than overall gland width GW in various embodiments. Of course, seal element 60 may likewise have corresponding dimensions.

Base surface 52 of gland 48 may have a first portion 56 (see FIG. 6*b*) characterized by a first gland width (GW1) and a second portion 58 characterized by a second gland width (GW2) with protrusion 54 formed at the intersection of the first and second portions, where overall gland width (GW) equals the sum of first and second gland widths (GW1+GW2). Likewise, gland 48 has a first gland depth (GD1) (see FIG. 6*a*) associated with the first portion 56 and a second gland depth (GD2) associated with the second portion 58. In the illustrated embodiment of FIG. 3, first and second gland widths are equal (GW1=GW2) and first and second gland depths are equal (GD1=GD2).

Figure 4:
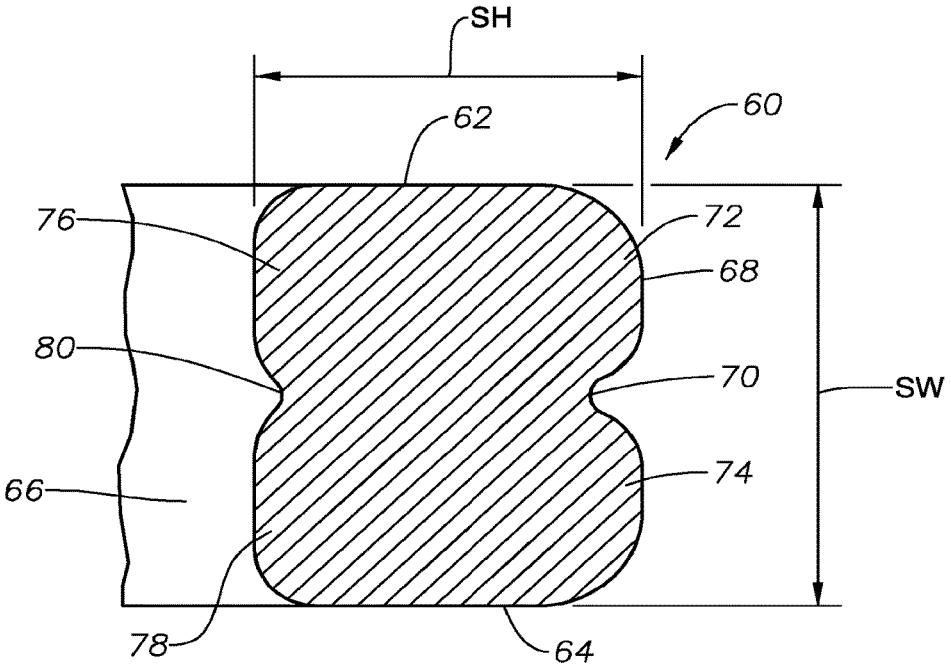
FIG. 4 is a first cross-sectional view of a seal element of the disclosure.
Figure 5:
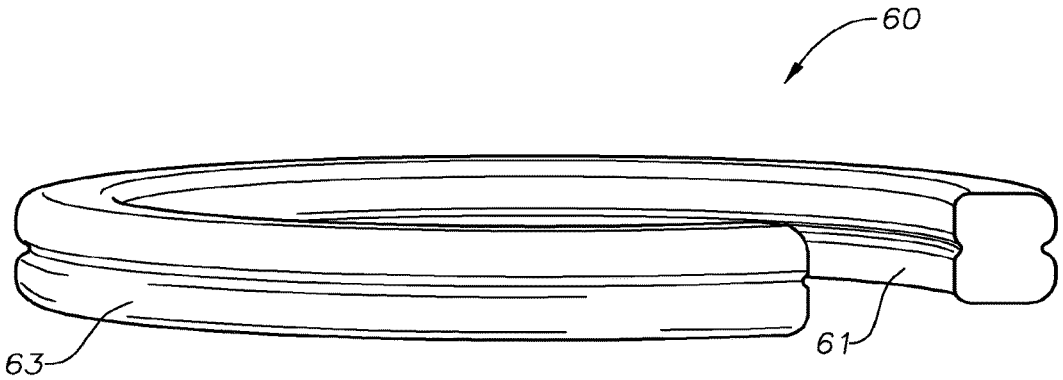
FIG. 5 is a second cross-sectional, three dimensional view of a seal element of the disclosure.

FIG. 4 is a cross-sectional view of the seal element 60, and FIG. 5 is a three dimensional view of the seal element 60, with a cross-sectional break out. With reference to FIGS. 4 and 5, and on-going reference to FIG. 3, seal assembly 46 further comprises a single, annular seal element 60 having an overall cross-sectional seal width SW and an overall cross-sectional seal height SH. Seal element 60 is generally circular in shape, characterized by an inner circumference 61 and an outer circumference 63. Seal element 60 is further characterized by a side surface 62, a side surface 64, an inner surface 66 formed along the inner circumference 61 and an outer surface 68 formed along the outer circumference 63. An annular recess 70 is formed in outer surface 68 so as to define a first lobe 72 and a second lobe 74 along outer surface 68. Recess 70 is shaped to engage protrusion 54 when seal element 60 is seated in gland 48. As with protrusion 54, recess 70 is not limited to a particular shape, but in preferred embodiments may have a square or rounded or peaked shape corresponding with that of protrusion 54.

In certain preferred embodiments, seal element 60 may include lobes 76, 78 formed on inner surface 66 with a void 80 formed therebetween. In these preferred embodiments, a single seal element having multiple lobes 76, 78 functions as if lobes 76, 78 were separate seal elements spaced apart along the length of the interface between inner surface 32 of cone 20 and outer surface 36 of journal 26. In other words, one lobe functions as the primary seal while the second lobe functions as a redundant or secondary seal. Void 80 may be utilized to provide bearing grease, oil or similar lubricant or cooling agent (not shown) to the contact surfaces of seal element 60. This may be particularly desirable in some cases because a single function agent (such as for cooling) may be charged into void 80 as opposed to formulations that may have to provide multiple functions, such as both bearing lubrication and seal cooling. Persons of ordinary skill in the art will appreciate that the presence of void 80 is preferably utilized in conjunction with a pressure compensation system (such as generally described in FIG. 2, as pressure equalizing device 44) utilizing a delivery channel such as channel 82.

Still referring to FIGS. 3, 4, and 5, protrusion 54 functions to add support to the single seal element 60 so that lobes 76, 78 can function as if they were separate seal elements. Moreover, protrusion 54 functions to retain seal element 60 seated in a proper position within gland 48. This is particularly desirable in cases where the overall seal width SW of seal element 60 is greater than the overall seal height SH of the seal element 60, adding lateral stability to seal element 60. Finally, protrusion 54 prevents pressurized fluid from migrating between the outer surface 66 of seal element 60 and the base surface 52 of gland 48. In other words, unlike void 80, a pressure compensation system cannot be utilized with recess 70 to inhibit a pressure imbalance. Thus, protrusion 54 inhibits potentially harmful pressurized fluid from collecting in recess 70. In this regard, it should be emphasized that the seal assembly 46 of the disclosure is specifically provided to use in downhole environments where the seal assembly 46 will be subjected to high pressures in the wellbore.

Those skilled in the art will appreciate that while two lobes are illustrated, additional lobes, or other surface shapes may be provided along inner surface 66. In another preferred embodiment, seal element 60 may only be provided with first lobe 72 and second lobe 74 along outer surface 68. In this embodiment, protrusion 54 continues to function to retain seal element 60 in a proper seated position within gland 48. Again, this is particularly desirable in cases where the overall seal width SW of seal element 60 is greater than the overall seal height SH of the seal element 60, adding lateral stability to seal element 60. Likewise, protrusion 54 also prevents pressurized fluid from migrating between the outer surface 68 of seal element 60 and the base surface 52 of gland 48.

Figure 6B:
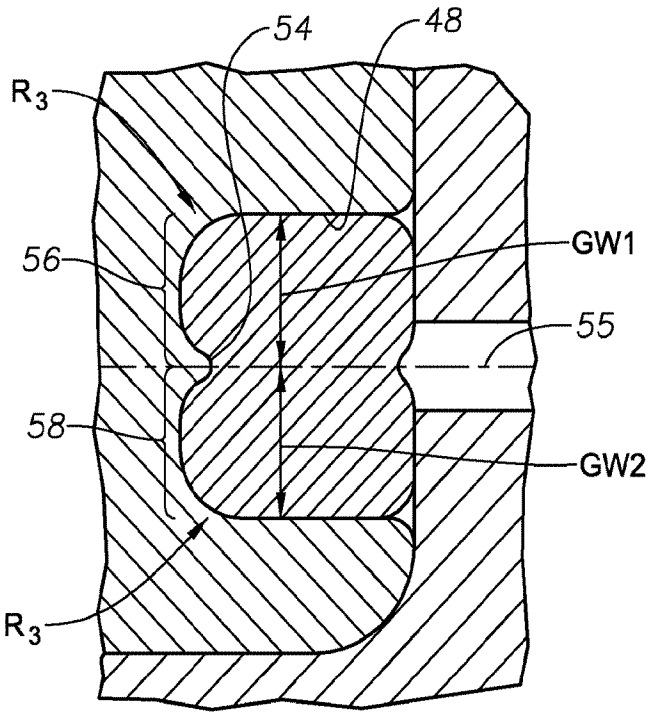
FIGS. 6*a* and 6*b* are cross-sectional views of the gland of the seal assembly of the disclosure illustrating gland widths and gland depths.
Figure 6A:
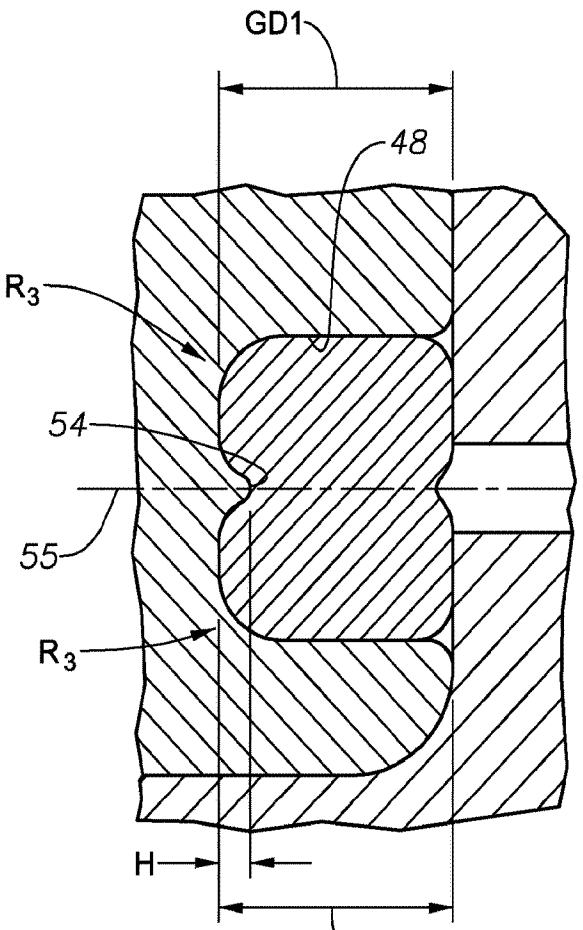

In certain preferred embodiments, the dimensions of separate portions of the components of seal assembly 46 may vary. FIGS. 6*a* and 6*b* are cross-sectional views of the gland 48 of seal assembly 46. With reference to FIGS. 6*a* and 6*b*, gland 48 is illustrated and generally bisected by an axis 55 passing through protrusion 54. In certain embodiments of gland 48, first gland width GW1 differs from second gland width GW2. For example, first gland width GW1 may be larger than second gland width GW2 or vice versa. Likewise, in certain embodiments, first gland depth GD1 differs from second gland depth GD2. For example, first gland depth GD1 may be larger than second gland depth GD2 or vice versa. Of course in such case where GD1 and GD2 differ, protrusion 54 will have a non-symmetrical shape about axis 55.

Figure 7B:
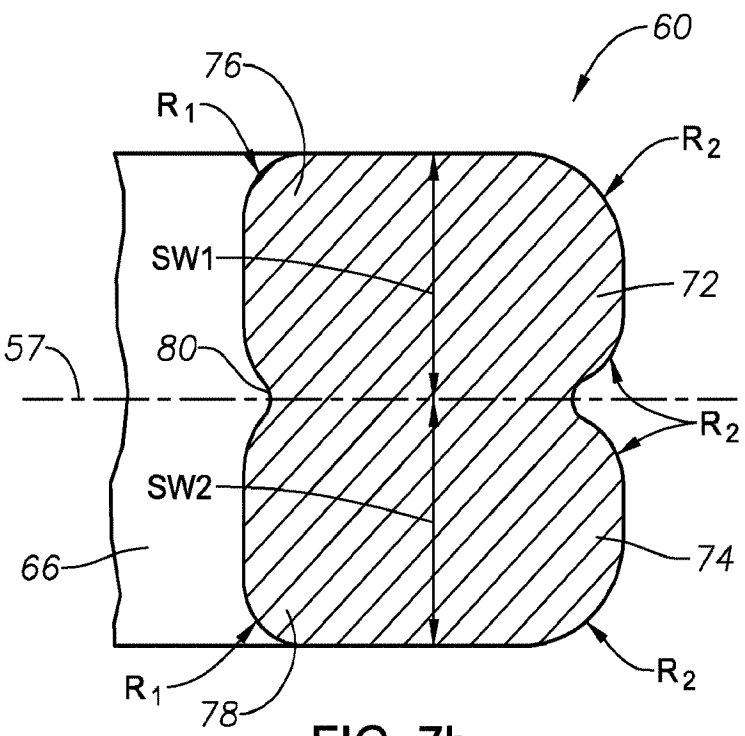
FIGS. 7*a* and 7*b* are cross-sectional views of the seal element of the seal assembly of the disclosure illustrating seal element widths and seal element depths.
Figure 7A:
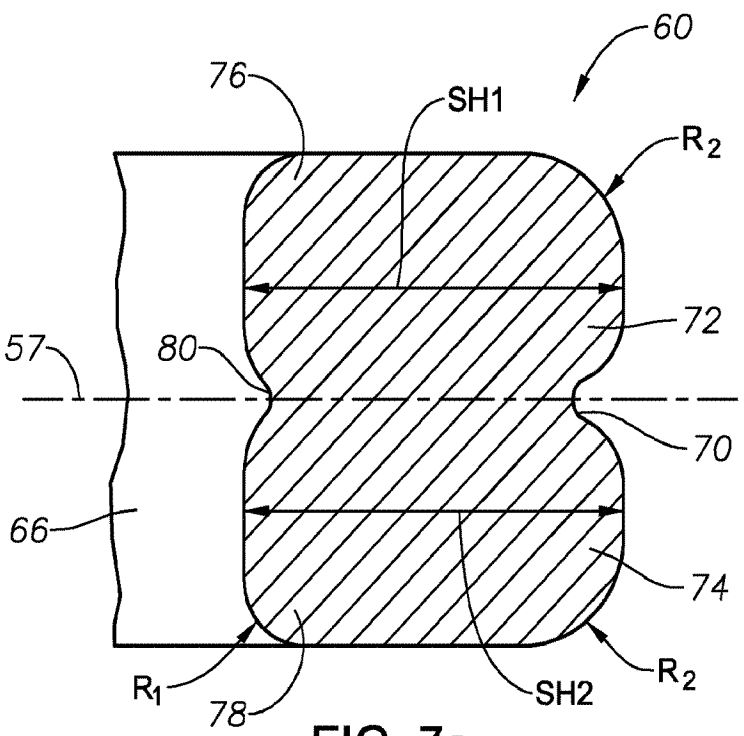

FIGS. 7*a* and 7*b* are cross-sectional views of the seal element 60 of seal assembly 46. As generally observed with respect to FIGS. 6*a* and 6*b*, seal element 60 of FIGS. 7*a* and 7*b* is illustrated and generally bisected by an axis 57 passing through recess 70. In certain embodiments of seal element 60, first seal width SW1 differs from second seal width SW2. For example, first seal width SW1 may be larger than second seal width SW2, or vice versa. Likewise, in certain embodiments, first seal depth SH1 differs from second seal depth SH2. For example, first seal depth SH1 may be larger than second seal depth SH2, or vice versa. In certain embodiments of seal element 60, GW1 may be equal to GW2. In certain embodiments of seal element 60, GD1 may be equal to GD2.

In the forgoing illustrations, preferably the widths and/or depths of the various portions of the seal element 20 are selected to correspond to the widths and/or depths of the various portions of the gland 48. Alternatively, the dimensions of either the gland 48 or the seal element 20 may be uniform, while the dimensions of the corresponding element may be varied. As an example, gland depths GD1 and GD2 may be the same, but seal element height SH1 may be larger than seal element height SH2, such that lobe 72 is compressed to a greater degree than lobe 74 when installed in a drill bit 10. In such case, it would be desirable to provide greater compression on the "first" or "front" seal lobe since it is exposed to cooling more so than the "second" or "back" seal lobe.

In certain embodiments of the disclosure, as best illustrated in FIGS. 6 and 7, lobes 76, 78 on inner surface 66 of element 60 may generally be characterized as having a first radius R1 at one or more corners of the lobes. First radius R1 may be the same or different dimension for each corner of inner surface 66 lobes as desired. Likewise, lobes 72, 74 on outer surface 68 of element 60 may generally be characterized as having a second radius R2 at one or more corners of the lobes. Second radius R2 may be the same or different dimension for each corner of outer surface 68 lobes as desired. Finally, gland 48 may generally be characterized as having a third radius R3 at one or more corners of gland 48 where the side surface 50 and base surface 52 intersect. Third radius R3 may also be formed at the intersections of base surface 52 and protrusion 54. Third radius R3 may be the same or different dimension for each corner of gland 48. In certain preferred embodiments of seal assembly 46, R3>R2>R1.

Seal element 60 may be formed of any standard material or combinations of materials. For example, seal element 60 may be formed of nitrile rubber (NBR), such as hydrogenated nitrile butadiene rubber (HNBR), also known as highly saturated nitrile (HSN) rubber. Other non-limiting examples of materials include fluoroelastomer, fluorocarbon elastomers, etc. The material may include fibers, granules or similar elements to improve strength, wear or similar properties. Although seal element 60 is a single, integral seal element, in certain embodiments, a portion of seal element 60 may be comprised of a first material and a portion of seal element 60 may be comprised of a second material different from the first material. For example, first lobe 68 may be comprised of a first material and second lobe 74 may be comprised of a second material different than the first material, the first and second materials utilized to integrally form a single, unitary seal element 60. Alternatively, a portion of seal element 60 along the outer circumference 63 may be comprised of a first material and a portion of seal element 60 along the inner circumference 61 may be comprised of a second material. For example, the first material in this embodiment may be harder or more rigid than the second material forming the lobes 76, 78, which may be more compressible.

While seal 60 has been illustrated with gland 48 formed in cone 20, persons of ordinary skill in the art will appreciate that gland 48 could also be formed in journal 26, in which case, the profile of surface 68 of seal element 60 would be formed on the inner circumference 61 of seal element 60 rather than the outer circumference 63.

An additional inwardly extending protrusion, similar to protrusion 54 may be disposed on one or both side surfaces 50 of gland 48 to further stabilize seal element 60 within gland 48.

Figure 8:
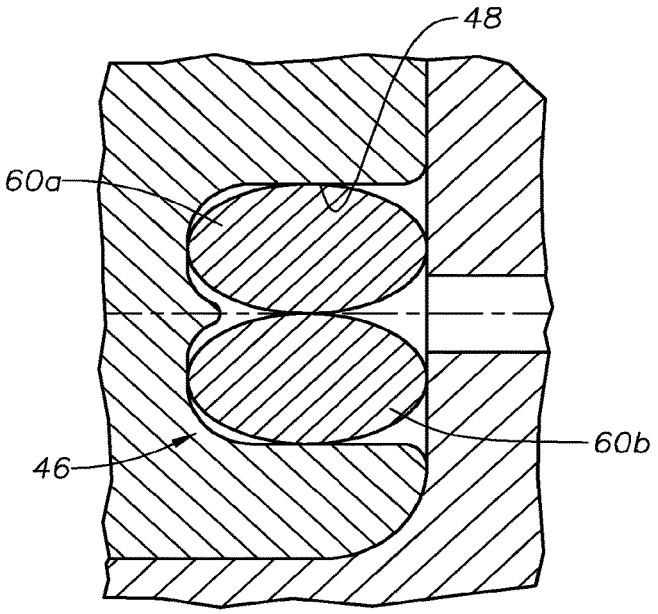
FIG. 8 is a cross-sectional view of the gland of the disclosure with two independent seals disposed therein.

Another embodiment of the disclosure is illustrated in FIG. 8, where single seal element 60 is replaced by two separate seal elements, 60*a* and 60*b*, which seat in gland 48 on either side of protrusion 54. Preferably, seal elements 60*a*, 60*b* abut one another and upon compression by a bearing surface 28, fully compress around protrusion 54. In this embodiment, two seals may be utilized, but with a single gland due to the presence of protrusion 54 for the reasons described above.

Although journal length is not intended to be a limitation in certain embodiments of the disclosure, it has been found the foregoing seal assembly is particularly useful in drill bits where the length of journal 26 is less than nine inches. In such drill bits, it is particularly important to maximize the contact area of bearing surfaces 32, 36. The foregoing seal assembly 46 accomplishes this with a single seal element, but still provides the redundant sealing benefits that may be achieved with larger drill bits having multiple sealing systems along the bearing surfaces.

Moreover, while the system is describes with respect to a cone rotating relative to a journal in a drill bit, the seal system may be utilized for other downhole applications where a first body is moving relative to a second body. For example, the seal assembly may be utilized to seal between two pipe strings or sub-assemblies rotating or sliding relative to one another in a wellbore.

The above disclosure describes seal assembly for use in high pressure downhole environments commonly found in the drilling of oil and gas wellbores. Moreover, the above disclosure describes a drill bit for drilling a wellbore, in which the drill bit includes a seal assembly as described above.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present disclosure being limited solely by the appended claims and their equivalents.

We claim:

1. A drill bit for drilling a wellbore, the drill bit comprising:

a gland formed by a single circumferential groove including opposing sides surfaces and a base surface extending therebetween, said gland defining an overall gland width (GW) and an overall gland depth (GD), the gland further comprising a protrusion formed along base surface between the opposing side surfaces;

a single, annular seal element disposed within the gland, the seal element having an overall cross-sectional seal width SW and an overall cross-sectional seal height SH; and a pressure compensation system disposed to deliver a pressurized fluid to the seal element;

wherein the seal element is characterized by a first side surface, a second side surface, an inner surface and an outer surface and having an annular recess formed along the outer surface so as to define a first lobe and a second lobe along outer surface;

wherein the seal element further comprises at least two lobes formed on the inner surface with a void formed therebetween;

wherein the pressure compensation system includes a channel that connects to the gland at the void formed between the at least two lobes formed on the inner surface.

2. The drill bit of claim 1, wherein the overall gland width GW is equal to or greater than the overall gland depth GD.

3. The drill bit of claim 1, wherein the protrusion has a height and the height is between approximately 5-25% of the overall gland depth.

4. The drill bit of claim 1 wherein the base surface includes a first portion having a first gland width and a first gland depth and a second portion having a second gland width and a second gland depth, the protrusion being formed at the intersection of the first and second portions.

5. The drill bit of claim 4, wherein the first gland width is different than the second gland width.

6. The drill bit of claim 4, wherein the first gland depth is different than the second gland depth.

7. The drill bit of claim 4, wherein the first gland width is different than the second gland width and the first gland depth is different than the second gland depth.

8. The drill bit of claim 1, wherein recess is shaped to engage the protrusion of the gland.

9. The drill bit of claim 1, wherein the first lobe has a first seal element width and a first seal element depth and the second lobe has a second seal element width and a second seal element depth, the recess being formed at the intersection of the first and second lobes.

10. The drill bit of claim 9, wherein the first seal element width is different than the second seal element width.

11. The drill bit of claim 9, wherein the first seal element depth is different than the second seal element depth.

12. The drill bit of claim 9, wherein the first seal element width is different than the second seal element width and the first seal element depth is different than the second seal element depth.

13. The drill bit of claim 9, wherein the base surface includes a first portion having a first gland width and a first gland depth and a second portion having a second gland width and a second gland depth, the protrusion being formed at the intersection of the first and second portions.

14. The drill bit of claim 13, wherein the first and second gland depths are the same as one another and the first and second seal element depths are different from one another.

15. The drill bit of claim 13, wherein the first and second gland depths are different from one another and the first and second seal elements depths are different from one another.

16. The drill bit of claim 1, further comprising a drill bit body having a plurality of arms, each arm having a journal pin with an outer journal surface;

a plurality of cones, each having an inner surface, wherein each arm rotatingly supports a cone, wherein the gland is disposed in the outer journal surface or the inner cone surface.

17. The drill bit of claim 1, further comprising a second annular seal element disposed within the gland adjacent the other seal element, wherein the protrusion extends partially between the two seal elements.

18. A drill bit for drilling a wellbore, the drill bit comprising:

a gland having an overall gland width (GW) and an overall gland depth (GD), wherein the overall gland width GW is equal to or greater than the overall gland depth GD, the gland further comprising opposing side surfaces and a base surface extending therebetween with a protrusion formed along base surface, wherein the base surface includes a first portion having a first gland width and a first gland depth and a second portion having a second gland width and a second gland depth, the protrusion being formed at the intersection of the first and second portions;

a single, annular seal element having an overall cross-sectional seal width SW and an overall cross-sectional seal height SH, wherein the seal element includes a first side surface, a second side surface, an inner surface and an outer surface and having an annular recess formed along the outer surface so as to define a first lobe and a second lobe along outer surface, wherein the first lobe has a first seal element width and a first seal element depth and the second lobe has a second seal element width and a second seal element depth, the recess being formed at the intersection of the first and second lobes; and a pressure compensation system disposed to deliver a pressurized fluid to the seal element;

wherein the seal element further comprises at least two lobes formed on the inner surface with a void formed therebetween;

wherein the pressure compensation system includes a channel that connects to the gland at the void formed between the at least two lobes formed on the inner surface.

19. The drill bit of claim 18, wherein the first seal element height is greater than the second seal element height.

20. The drill bit of claim 18, wherein the protrusion has a height and the height of the protrusion is no more than 50% of the overall gland depth.

21. An assembly for a wellbore, the assembly comprising:

a first body having a first surface;

a second body, movable relative to the first body, the second body having a second surface adjacent the first surface;

a gland having an overall gland width (GW) and an overall gland depth (GD), wherein the overall gland width GW is equal to or greater than the overall gland depth GD, the gland further comprising opposing side surfaces and a base surface extending therebetween with a protrusion formed along base surface, wherein the base surface includes a first portion having a first gland width and a first gland depth and a second portion having a second gland width and a second gland depth, the protrusion being formed at the intersection of the first and second portions;

a single, annular seal element having an overall cross-sectional seal width SW and an overall cross-sectional seal height SH, wherein the seal element includes a first side surface, a second side surface, an inner surface and an outer surface and having an annular recess formed along the outer surface so as to define a first lobe and a second lobe along outer surface, wherein the first lobe has a first seal element width and a first seal element depth and the second lobe has a second seal element width and a second seal element depth, the recess being formed at the intersection of the first and second lobes; and a pressure compensation system disposed to deliver a pressurized fluid to the seal element;

wherein the seal element further comprises at least two lobes formed on the inner surface with a void formed therebetween;

wherein the pressure compensation system includes a channel that connects to the gland at the void formed between the at least two lobes formed on the inner surface.

22. The assembly of claim 21, wherein the first seal element height is greater than the second seal element height.

23. The assembly of claim 21, wherein the protrusion has a height and the height of the protrusion is no more than 50% of the overall gland depth.

24. The assembly of claim 21, wherein the annular seal element includes a first radius R1 formed at the intersection of a side surface of the seal element and the inner surface of the seal element, a second radius R2 formed at the intersection of a side surface of the seal element and the outer surface of the seal element, and the gland includes a third radius R3 formed at the intersection of a side surface and the base surface, wherein R3>R2>R1.

* * * * *